United States Patent [19]

Ballestrazzi et al.

[11] Patent Number: 4,831,809

[45] Date of Patent: May 23, 1989

[54] PACKAGING MACHINE FOR THE CONTINUOUS PACKAGING OF INDIVIDUAL PRODUCTS, AND OF GROUPS OF OVERLAPPED PRODUCTS HAVING A VARIABLE HEIGHT

[75] Inventors: Aris Ballestrazzi; Lamberto Tassi, both of Savignano Sul Panaro, Italy

[73] Assignee: SITMA - Societa Italiana Macchine Automatiche S.p.A., Modena, Italy

[21] Appl. No.: 224,079

[22] Filed: Jul. 25, 1988

[30] Foreign Application Priority Data

Aug. 27, 1987 [IT] Italy ..... 21733 A/87

[51] Int. Cl.[4] ..... B65B 9/02; B65B 57/16

[52] U.S. Cl. ..... 53/64; 53/76; 53/553; 53/528; 198/343

[58] Field of Search ..... 53/64, 76, 228, 528, 53/553; 198/343

[56] References Cited

U.S. PATENT DOCUMENTS 3,307,326 3/1967 Krebs ..... 53/528
3,618,740 11/1971 Tavern ..... 53/553 X
4,019,307 4/1977 Ballestrazzi ..... 53/553 X
4,313,288 2/1982 Tassi ..... 53/553 X

*Primary Examiner*—John Sipos
*Attorney, Agent, or Firm*—Hedman, Gibson, Costigan & Hoare

[57] ABSTRACT

A packaging machine suitable for the continuous packaging of individual products, or of groups of overlapped products having a different size in height, such as signatures, newspapers, magazines, books, and the like, and provided with at least one running-belt pressing device which is vertically shiftable and is made integral with a car which suitable for reciprocating inside the packaging machine, and which supports a transversal-welding unit, which is provided with a combined motion of the welding element both downwards towards and products and of accompanying of the same products, so as to make it possible said products to be correctly packaged and to be perfectly stacked, with the packaging of even one individual product being made possible, independently on whether it even contains an extremely small number of pages.

10 Claims, 4 Drawing Sheets

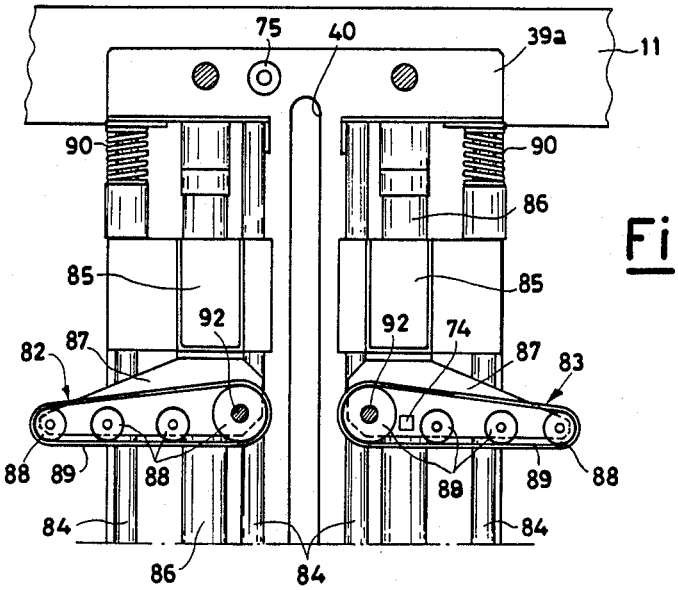
Fig.3
Fig.4
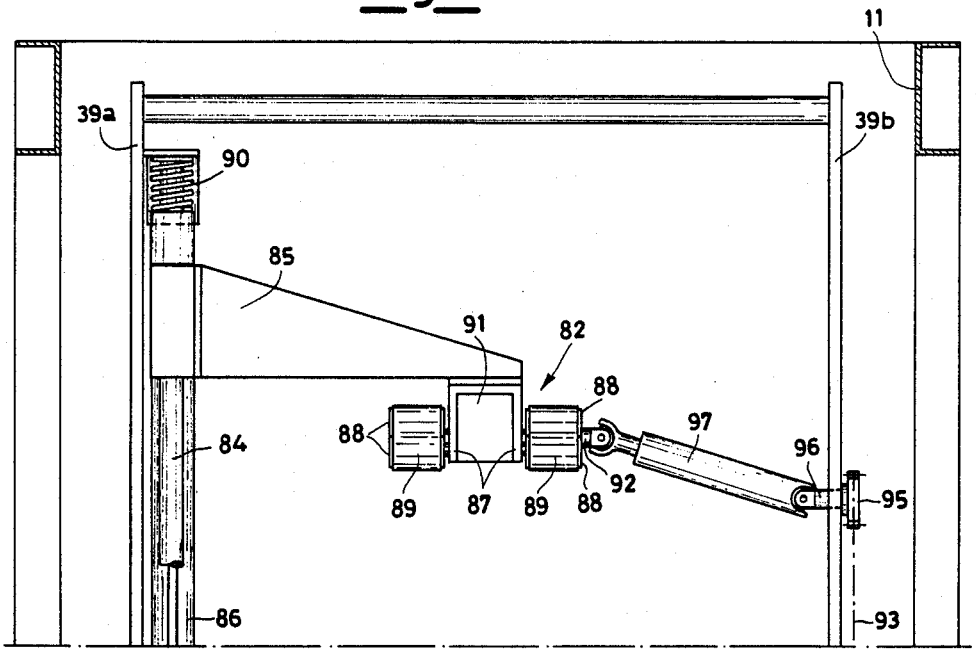

PACKAGING MACHINE FOR THE CONTINUOUS PACKAGING OF INDIVIDUAL PRODUCTS, AND OF GROUPS OF OVERLAPPED PRODUCTS HAVING A VARIABLE HEIGHT

The present invention relates to a packaging machine, for the continuous packaging of individual products, and of groups of overlapped products having a variable height.

Packaging products or groups of overlapped products, such as signatures, newspapers, magazines, books and the like, inside a continuous material, such as a film of a plastic material, on packaging machines provided with a conveyor unit above which the product (or the overlapped products) to be packaged is made run and is fed towards a transversal welding unit, is known.

Under said welding unit the product, after that the conveyor belt is stopped, is welded wrapped inside the packaging film, after which the conveyor unit, by being started again, finally discharges the packaged product towards an oven wherein the heat-shrinking takes place, or towards a longitudinal side welding unit for the longitudinal welding of the package before the possible heat-shrinking thereof, suitable for supplying a properly formed package.

It clearly appears that this type of packaging route involves a time waste owing to the stop during the welding step, with the consequent loss of production, and limited packaging speed, and, in particular when groups of overlapped products are packaged, it does not succed in securing the preservation of a perfect stack.

The prior art attempted to solve the problem of the stack preservation by providing, upstream and downstream the welding unit, pressing devices provided with pressing belt elements, which are vertically movable relatively to the conveyor belt unit, such as to preserve the stack arrangement during the transversal welding. Providing said pressing devices for pressing the product (or product group), shiftable above the conveyor belt, involved an—even if very small—increase in the dead times for their down-stroke until they come into contact with said product, once that the conveyor belt is stopped. In order to realize the partial recovery of the dead times, the high-speed transfer of the product and/or of the group of overlapped products is then provided from the machine inlet until the product, or the group of overlapped products, comes in correspondence of the point of tranversal welding, anyway determining a misarrangement of the stack generated from said products.

Packaging machines are known for the packaging of low-thickness products, which use transversal welding units installed on board of a car, and are vertically movable, so as to be provided with a movement of elliptical type, which enable a certain time saving to be obtained by carrying out the packaging in a continuous mode, but which unfortunately cannot be used in order to package products having a whatever height.

The purpose of the present invention is on the contrary to provide a continuous packaging machine for the continuous packaging of individual products or of groups of overlapped products of the hereinabove mentioned type, which makes it possible the times of the stop time required for the transversal welding to be annulled, with the production and the packaging speed being simultaneously increased, with the correct packaging of an individual signature couple, or of a newspaper having a minimum amount of pages, and any length, as well as of a group of overlapped products of the above type being simultaneously carried out, with said stack of products being maintained in proper order and being not misarranged.

This purpose according to the present invention is achieved by providing a packaging machine for the continuous packaging of individual products, or of groups of overlapped products having a variable height, such as signatures, newspapers, magazines, books and the like, of a type comprising a framework fitted with conveyor means for conveying the products to be packaged, a transversal welding unit for the transversal welding of a plastic material having the form of a continuous sheet suitable for wrapping said products to be packaged, wherein said continuous-sheet material is fed by a couple of bobbins positioned on relevant unwinding units and free ends of said bobbins are transversely welded so as to form a single continuous sheet, with said conveyor means being a first conveyor belt and a second conveyor belt respectively positioned upstream and downstream said welding unit, which is transversal relatively to the direction of unwinding of said packaging material and which is composed by an upper, vertically movable, welding bar, and by a lower welding bar, stationary, and positioned at the same level as of said first and second conveyor belts, with furthermore at least one pressing device being provided, which is vertically movable above said products in the nearby of said welding unit, and relevant motor means and actuator means being provided, characterized in that said welding unit is positioned on a horizontally translatable car, with said car bearing, on opposite sides relatively to said welding unit, a return roller of said first conveyor belt and a return roller of said second conveyor belt, wherein said first conveyor belt and said second conveyor belt run along a closed-loop path and are provided with a belt tightening device suitable for enabling them to correctly operate, a centralized motor means being provided, which, through a first transmission, determines the continuous revolution of said conveyor belts, and, with the interposition of a brake-clutch unit, selectively actuated by sensor means monitoring the position of said products on said conveyor belts, drives an intermediate shaft to revolve in order to actuate a cam for the vertical movement of said upper welding bar and for actuating a crank and slotted link for driving the horizontal reciprocating of said car, with at least one return roller of said conveyor belts causing a belt of said at least one pressing device to move in synchronism with it, and in an opposite direction of revolution, which said at least one pressing device being also positioned on said car, and being vertically shiftable, by being actuated by at least one of said sensor means.

The structural and functional characteristics and the advantages of a packaging machine according to the present invention will be better understood from the following exemplifying and non-limitative disclosure, referred to the hereto attached drawings, wherein:

FIG. 3 shows a magnified longitudinal sectional view of the upper portion of the machine of FIG. 1, FIG. 4 is a magnified transversal sectional view of the pressing devices of belt type and of the mechanisms which control their movement.

Figure 1:
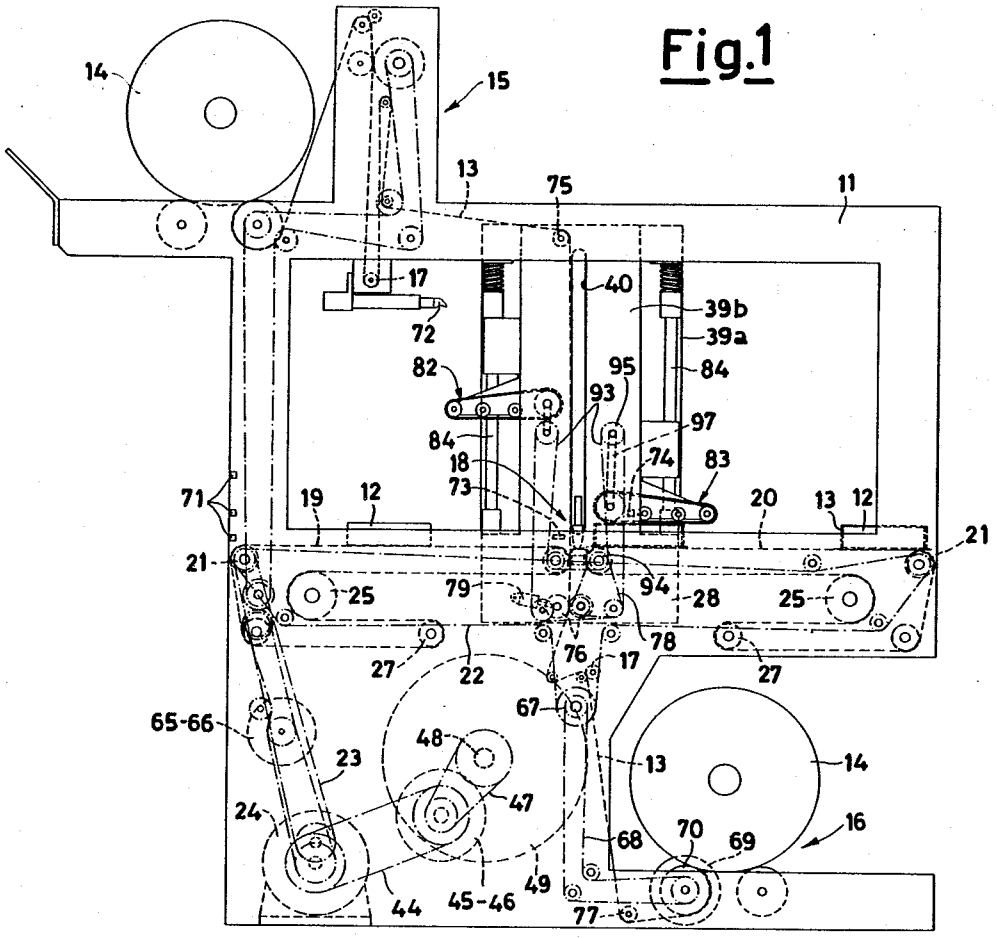
FIG. 1 shows a side elevation view of a packaging machine in its welding position, wherein the film path with the relevant unwinding units, and the drive mechanisms driving the conveyor belts and the pressing devices of pressing-belt type accompanying the product during the welding cycle, are shown.

Referring to the drawings, a continuous packaging machine according to the present invention comprises a framework, generally indicated by the reference numeral 11, on which a plurality of operating units—the transversal welding unit, the product conveyor units, the drive units, the unwinding units for unwinding the continuous wrapping material, the belt-pressing devices for accompanying the product(s) during the welding cycle, and so forth—are installed, which are such as to make it possible individual products, or groups of overlapped products to be packaged in continuous, with said individual products/groups of overlapped products being indicated by the reference numeral 12, and having a size, both in height and in length, which may vary relatively to one another, and are fed after each other according to a whatever order, such as signatures, newpapers, magazines, books and the like.

As depicted in the figures, a continuous wrapping or packaging material 13, such as, e.g., a continuous heat-shrinking plastic film, is fed by a couple of bobbins 14 respectively positioned on an upper unwinding unit 15 and on a lower unwinding unit 16, fitted with compensating means 17, such as so-said "dandy rolls", which make it possible the same film 13 to be constantly and continuously, parallelly fed to a transversal welding unit, generally indicated by the reference number 18, which constrains it around the product 12, cutting it and welding it in correspondence of the leading edge and of the trailing edge of said product 12 (FIG. 1).

The product (or products) 12 is (are) in fact fed in a known way by means of a conveyor belt (not shown in the figures) above a first conveyor belt 19 installed upstream said transversal welding unit 18 and is subsequently made advance towards a second conveyor belt 20 installed downstream said transversal welding unit 18. Both said conveyor belts 19 and 20 run along a closed-loop path and are caused to revolve by a couple of drive rolls 21, linked with each other by a chain transmission 22, and driven by a transmission 23, also of chain-transmission type, driven by a main centralized motor-speed variator unit 24, which is suitable for supplying the movement to all the operating units of the packaging machine.

Figure 2:
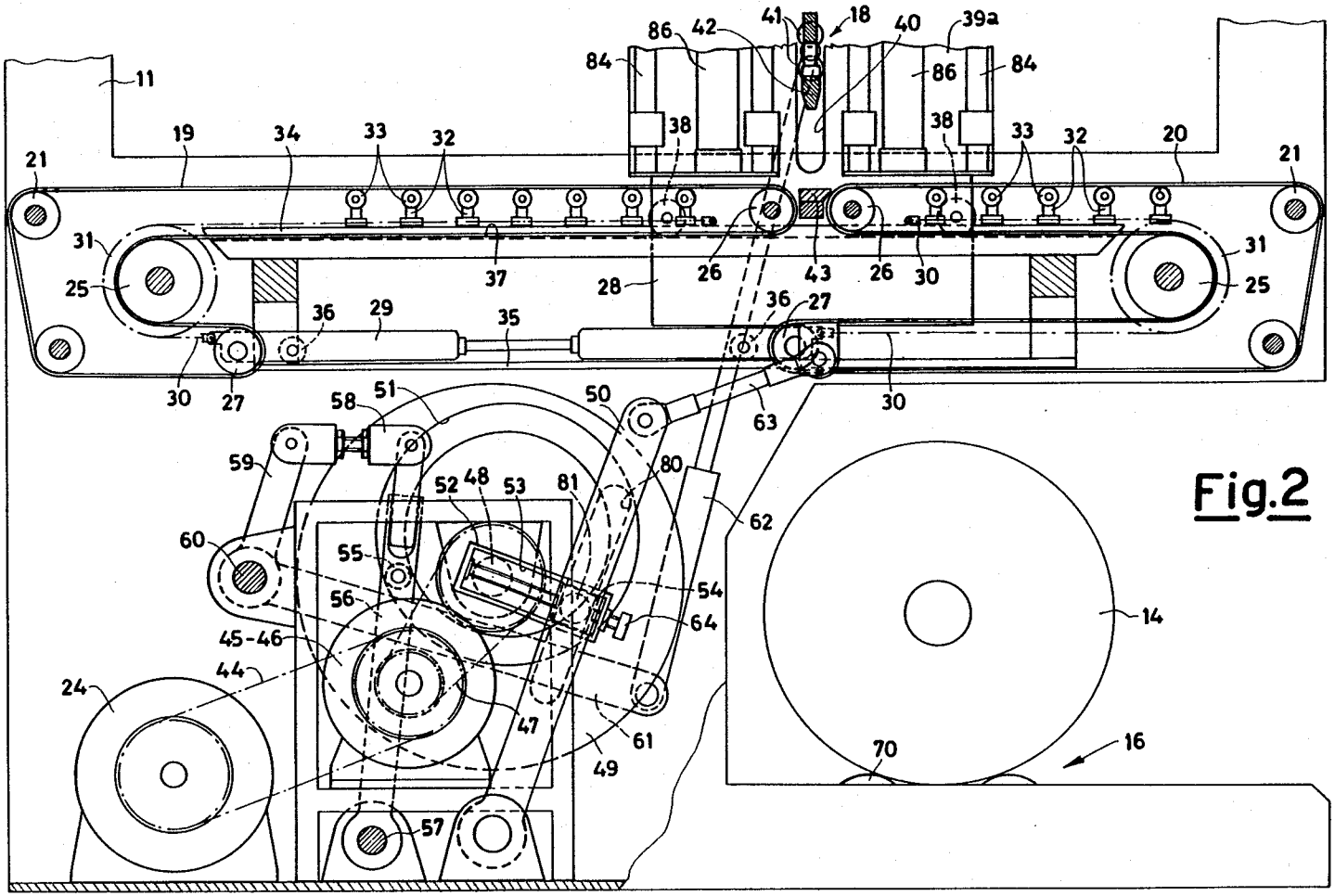
FIG. 2 shows a magnified longitudinal sectional view of the lower portion of the machine of FIG. 1 in a different operating position.

The conveyor belts 19 and 20 have a mutually specular shape, run along an essentially trapezoidal path and the mutually opposite sides of both paths show a "C"-shaped recess individuated by a stationary return roll 25 fastened to the framework 11. At the ends of said sides of said "C"-shaped recess, two further rolls 26 and 27 are positioned, which are horizontally movable relatively to the framework 11. In fact, the upper roll 26 is integrally rotatable relatively to a central car 28, on which said transversal welding unit 18 is mounted, whilst the lower roll 27 is integrally rotatable relatively to a tightening device 29, so designed as to link both said lower rolls 27 of both conveyor belts 19 and 20 (FIG. 2). Such a tightening device 29 connects the lower end of two chain portions 30 which, after running around two sprocket wheels 31 coaxially positioned relatively to the stationary rolls 25, are constrained to the central car 28, at the top thereof, nearly in correspondence of the upper rolls 26.

A plurality of supports 32, constrained to the chain portions 30, bear an equal number of rolls 33 constituting a roller apron on which the upper portions of both conveyor belts 19 and 20 slide in the area wherein the product 12 are fed. The chain portions 30 slide on a flat guide 34 which is integral with the framework 11; also integral with the framework 11 is a further flat guide 35 on which the tightening device 29 is guided by means of rolls 36 integral with it. The framework 11 furthermore supports further flat guides 37 on which support rolls 38 slide, which are integral, at the bottom, with the central car 28, so that also said central car 28 can horizontally translate.

The central car 28, which can horizontally reciprocate, is provided with two shoulder portions, or body sides **39*a* and 39*b*, which extend upwards and through which slots 40 are provided, inside which support rolls 41 slide, which support the opposite ends of an upper welding bar 42 vertically movable inside said slots, which, together with a lower welding bar 43, stationary relatively to the central car 28, constitutes the abovesaid transversal welding unit 18**.

Inside said shoulder portions **39*a* and 39*b*, and said same car 28, the film 13 is made run (FIG. 1), according to a vertical direction parallel to the direction of movement of the welding bar of the transversal welding unit 18**. Said film is continuous, in that the film coming from the upper bobbin, and the film coming from the lower bobbin have been previously made integral with each other by means of a transversal welding.

More precisely, the film 13 coming from the upper bobbin 14, once that it has left the upper unwinding unit 15, is guided by a return roll 75 between the shoulder portions **39*a* and 39*b* of the car 28 towards a calender 76 positioned under the upper rolls 26, and on board of the central car 28, and driven to revolve by a transmission 78 integral with the upper roll 26 of the second conveyor belt 20. The above said calender 76 acts as a means for guiding, driving and unwinding the film 13, which comes from the lower unwinding unit 16 and is deviated towards it by return rolls 77 integral with the framework 11 of the machine (FIG. 1), and is engaged on the same film by means of actuator means 79**, e.g., constituted by a cylinder, controlled by suitable sensor means which are disclosed in the following.

The lower welding bar 43, which is positioned in the area of the separation of the two conveyor belts 19, 20, has its upper surface approximately at the same level as of the same belts, but in such a way as to enable the so-generated continuous film coming from the upper unwinding unit 15 and from the lower calender 76, to run through.

The horizontal reciprocating movement of the central car 28, as well as the vertical movement of the upper welding bar 42 are determined in a purely mechanical way according to a certain law deriving from the particular form of practical embodiment of a cam-crank and slotted link unit coupled with relevant levers which transmit the relevant motion to the upper welding bar, and to the welding unit supporting car, which furthermore makes it possible the upper, inner, mutually-opposite ends of both conveyor belts to be shifted.

In fact, exiting from said centralized motor-speed variator unit 24 (FIG. 1), a toothed belt 44 transmits the movement to a reduction gear 45, with the interposition of a brake-clutch unit 46. Furthermore, a small transmission 47, e.g., a chain-type transmission, drives a main intermediate shaft 48 to revolve, from the ends of said main intermediate shaft 48 the revolutionary motion being taken, which drives a cam 49 which controls the movement of the upper welding bar 42 and respectively of a swinging crank and slotted link 50 for the horizontal reciprocating of the central car 28 (FIG. 2).

The main intermediate shaft 48 is integral, at an end, with a disk-cam 49, which is provided with an eccentrically-positioned groove 51; and at its other end, said main intermediate shaft 48 is integral with an eccentric lever, i.e., a crank 52; with a pin 54, which drives the swinging lever, i.e., the crank and slotted link, 50, being suitable for being radially positioned inside a groove 53 provided in said crank 52. The position of said pin 54 inside the groove 53 is adjustable relatively to said main intermediate shaft 48.

Now, examining at first the drive of the upper welding bar 42, one can observe that inside the eccentric groove 51 of the disk-cam 49 an idle roll 55 is inserted, which protrudes from an intermediate portion of a swinging lever 56, which is hinged, in correspondance of its lower end, in 57, and at its other end bears an articulated, adjustable lever 58. Said articulated lever 58 is linked in its turn to a drive lever 59 keyed on a reciprocating shaft 60 which bears, at its opposite ends, a couple of levers 61 which drive the movement of the upper welding bar 42, and are linked to said upper welding bar 42 by means of respective tie-rods 62, each of which incorporates a shock-absorber mechanism, not shown in the figures, in order to optimize the transversal welding of the wrapping film 13.

The crank 52, installed at the other end of the intermediate shaft 48, by causing the pin 54 to rotate, causes the crank and slotted link 50 to swing; with such crank and slotted link 50 the central car 28 is articulatedly linked by means of an adjustable tie-rod 63, which central car 28 being thus caused to reciprocate. The crank and slotted link 50 is provided with a groove 80, inside which a runner or pad element 81, positioned on the end of said pin 54, can slide. As said, the pin 54 can be shifted in an adjustable way inside the groove 53, e.g., by means of an adjustment screw 64, so that the length of the stroke of the central car 28, or, better, the amplitude of its reciprocating movement, can be changed at will, with varying lengths of the product to be packaged. In this way, by adequately adjusting the length of the stroke of the car 28 which bears the welding unit 18, the speed thereof can properly match the speed of the conveyor belts with varying product lengths.

The upper unwinding unit 15 is driven by a kinematic transmission which draws the motion directly from the outlet end of the centralized motor-speed variator unit 24, with a speed reduction gear 65 and a brake-cluth unit 66 being interposed (FIG. 1).

On the contrary, the lower unwinding unit 16 draws its motion from a sprocket wheel 67, which interacts with the chain transmission 22 which drives the driving rolls 21 of the conveyor belt 19 and of the conveyor belt 20. Said sprocket wheel 67 drives a chain 68 which, with the interposition of a coupling 69, causes an unwinding roll 70 to revolve in order to unwind the lower bobbin 14, whenever necessary.

Furthermore, the car 28 respectively supports, at its upstream and downstream sides, in the nearby of the transversal welding unit 18, between the shoulder portions 39*a*, 39*b*, in an essentially central position above the conveyor belts 19 and 20, an inlet pressing device 82 and an outlet pressing device 83, which accompany the individual product, and/or the group of overlapped products 12 during the packaging and transversal-welding cycle (FIG. 1).

In fact, one of said side vertical shoulder portions 39*a* of the car 28 is fitted, towards the interior of the machine, with vertical studs 84 which perform the task of guiding shaped supporting bracket elements 85, which act as a slide, and support said pressing devices 82 and 83, positioned specularly opposite to each other, during their vertical movement above the conveyor belts 19 and 20 determined by cylinders 86 also integral with said shoulder portion 39*a* (FIGS. 1 and 3).

Two vertical walls 87 positioned side-by-side to, and spaced apart from, each other, and extending downwards from each one of said support elements 85, rotatably support rotatable horizontal rolls 88 transversely directed towards the shoulder portions 39*a* and 39*b* of the machine, in order to slidingly support small-size, closed-loop belts 89, opposite to the conveyor belts 19 and 20. One of said rolls 88 of each one of said belts 89 is keyed on a shaft 92 which is motor-driven, as hereinunder explained. The studs 84 can be provided with cushioned stop means 90 installed at both their upper and lower ends, also acting as stroke-limit elements. Between said two vertical, spaced-apart walls 87, an opening 91 is defined, which is suitable for making it possible hereinunder disclosed suitable sensor means 73 to operate.

The other shoulder portion, or body side 39*b* of the car 28 supports, towards the external side of the machine, the transmission which causes the belts 89 of both pressing devices 82 and 83 to revolve. In fact, a chain transmission 93 draws its motion from a sprocket wheel 94 coaxial and integral with the upper roller 26 of the second conveyor belt 20. Said transmission 93 runs around idle return sprocket wheels and also around two further sprocket wheels 95, which drive to revolve relevant shafts 96 integral with them, with said shafts 96 being articulatedly linked at their ends with Cardan joints 97 (FIG. 4).

The above said Cardan joints 97 are provided with rod portions of telescopic type, such as to adapt their length, during the vertical translation of the support elements 85 of the belts 89, and at their ends opposite to those ends at which they receive the revolution movement from the sprocket wheels 95, they are linked to an end of the shafts 92, causing said shafts 92 to continuously revolve.

It should be observed that such a transmission makes it possible the direction of revolution of the belts 89 of both pressing devices to be reversed relatively to the direction of revolution of both conveyor belts 19 and 20, and is simultaneously capable of transmitting the same speed of linear feed thereof, also absorbing any possible interruptions in their movement relatively to the movement of the car 28.

Together with these devices of essentially mechanical type, suitable sensor elements are provided in the machine, which control and correlate the various movements of the packaging machine, so as to cause it to perfectly and correctly operate, in particular acting on the movement of the main car, on the movement of the upper welding bar, and on the movement of both pressing devices in order to achieve the purpose of the invention. For example, at the inlet side of the machine, a first set of photocells 71, vertically positioned on the framework 11, is provided (FIG. 1), which detect the arrival of a product or of a group of products 12, and defines the size in height thereof, presetting a time (relevant, e.g., to a "low", "medium" or "high" product), both for the actuation of the upper unwinding unit 15, and, in general, for the sinking of both pressing devices 82 and 83, if necessary. The welding cycle is then started by a second photocell 72, which is preferably positioned on the same plane as of the first conveyor belt 19. In fact, said first conveyor belt 19 is preferably composed by two conveyor belts placed side-by-side to, and spaced apart from, each other, wherein, in an area of separation thereof along their adjacent sides, an upwards-facing receiver element (not shown in the figures) for said photocell 72 is positioned. Furthermore, in case the product 12 is a single, low piece with a minimum amount of pages, the second photocell 72 detects the leading edge thereof, and commands at least the first pressing device 82 to move downwards above the product, so as to perform the function of accompanying it during the step of insertion thereof inside the packaging film 13, preventing it from getting disarranged owing to its low stiffness.

A third photocell 73 is also positioned in the area between said two side-by-side belts of the first conveyor belt 19, in the nearby of its end outlet portion and, once that it detects the arrival of the product, starts, by means of the intervention of the cylinder 79, the engagement of the drive calender 76 on the film 13, thus enabling the plastic film 13 to wrap on both the upper and lower sides the product made advance by the conveyor belts 19 and 20 and possibly by the pressing device 82, with the drive calender 76 being only disengaged when the trailing edge of the product is detected.

Of course, the lower unwinding unit 16 determines the unwinding of the film from the lower bobbin 14 when the relevant compensator means 17 command the coupling 69 to engage, so as to make the unwinding roll 70 revolve.

Finally, a fourth photocell 74 is furthermore provided, and is positioned beyond the area of separation between the two conveyor belts 19, 20, or, better, at the inlet end of the second belt 20 and above it, which, by detecting the trailing edge of the passed and packaged product, controls the perfect prosecution of machine's operation, stopping the downwards movement of the second pressing device 83 and starting the upwards return movement of the first pressing device 82. Said fourth photocell 74 is preferably positioned directly on said second pressing device 83. The provision of said sensor elements or photocells allows the operation of the packaging machine according to the present invention to be clearly understood.

In fact, as hereinabove said, a conveyor means feeds the products after each other towards the packaging machine and said feed is initialy detected by the first set of photocells 71 at the inlet end of the first conveyor belt 19, in case the product is a medium-height product or a high-height product, whilst in the event the product is low, e.g., a newspaper with a minimum amount of pages, no product detection takes place.

In case the product is a medium-height product, or a high-height product, a time is preset for the downwards movement of the pressing device 83 downstream the welding unit, whilst the upstream pressing device 82 is possibly prevented from sinking, as shown in FIG. 1. Thereafter, the product continues to advance on board of the conveyor belt 19, until the passage thereof in correspondence of the second photocell 72 confirms the feed of a medium-high product, or detects the feed of a so-said low product. In this latter case, the first pressing device 82 is commanded to sink down on said low product.

Then, in both cases, the third photocell 73 commands the drive calender 76 to reach its engagement position, with the lower unwinding unit 16 being started, thus enabling the film 13 to wrap the product both at the top and at the bottom, in that the film coming from the upper bobbin of the upper unwinding unit 15 is bonded to the film coming from the lower unwinding unit, by means of a transversal welding previously carried out. When the second photocell 72 detects the trailing end of the product 12, said detection starts the cycle of welding-central car shifting by means of the brake-clutch unit 46 which, by getting engaged, enables the motion to be transmitted. Of course, the third photocell 73, when detects the trailing edge of the product 12, disengages the drive calender 76 and causes the lower unwinding unit 16 to stop, so that, after that the welding and the cutting of the film have been simultaneously carried out, said film positions again itself in a nearly vertical position inside the car 28, nearly parallel to the direction of movement of the welding unit, ready to receive a new product.

The engagement of the brake-clutch unit 46 makes the disk-cam 49 revolve, in order to actuate the upper welding bar 42, and makes the crank and slotted link 50 start to swing, which causes the central car 28 to reciprocate.

The downwards movement of the pressing device 83 continues, according to the programmed delay relatively to the first pressing device 82, until the fourth photocell 74 detects the presence of the product, stopping said downwards movement, and simultaneously sending the command for the first pressing device 82 to return upwards again, if it had been previously lowered on the product.

When the welding is ended, in a mechanical way, e.g., by means of drive cams, not shown in the figures, also the second pressing device 83 is driven to return upwards, so that the conveyor belt 20 can discharge the so packaged product.

Figure 5:
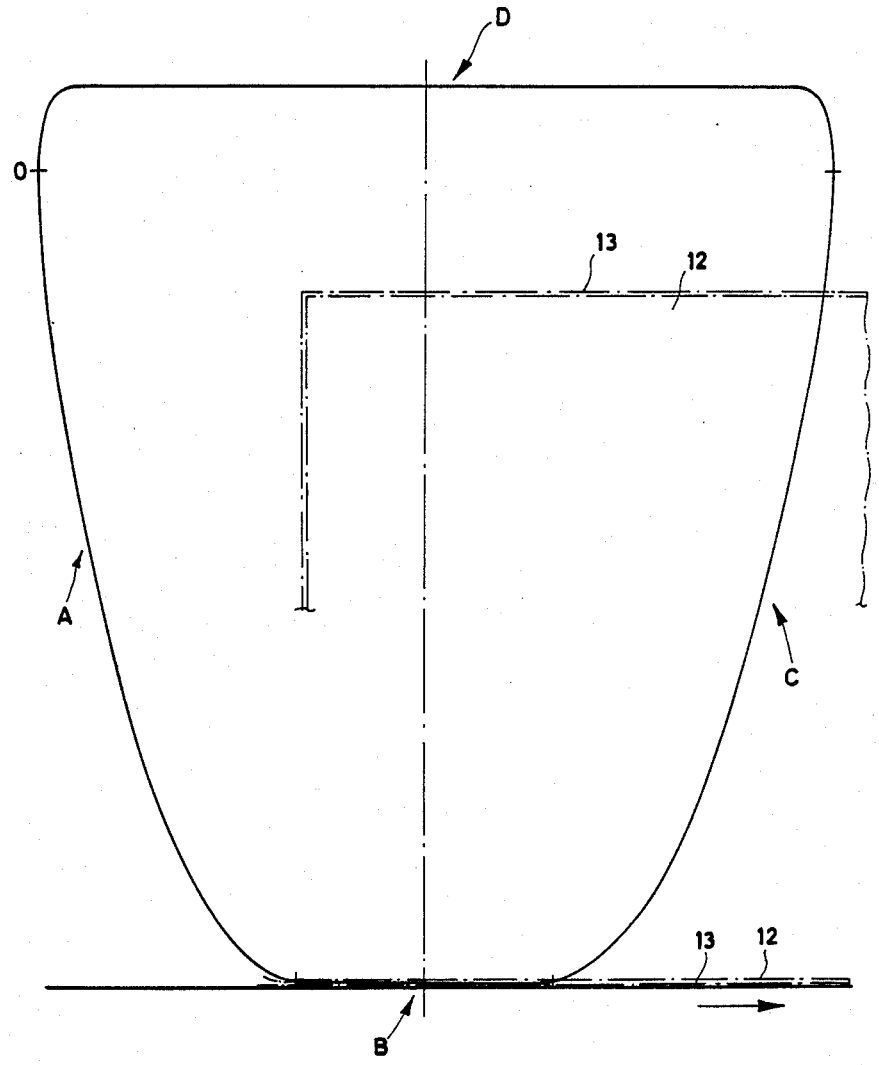
FIG. 5 is a chart showing the combined motion of the welding unit and of the car.

In FIG. 5, the combined movement which derives from the above is depicted; one can observe that the (A) step of approaching of the welding bar towards its position of engagement with the material to be packaged, the (C) step of removal, and the (D) step of car return are rather fast, whilst the (B) step of accompanying during the welding step is slower. By the "O" character, the point relevant to the stand-by position, at which the welding cycle starts, is indicated, and in chain portions of film-wrapped products are also indicated, which respectively have a minimum and a medium-high height, wherein the minimizing in wrapping film consumption can be observed.

It should be observed that the (A) step, and the (C) step, respectively of approaching and of removal of the welding bar, take place on a nearly vertical direction, with the welding unit travelling in the same direction of advancement as of the conveyor belts, still in order to minimize the consumption of the packaging film. According to a generic and exemplifying formulation, the whole cycle could be subdivided, as regards the total revolution angle, into three angles of approximately 100° each, for the first three (A), (C) and (D) steps, and an angle of 60° as regards the last (B) step, of accompanying during the welding step. The combination of the movements of said cam and of said swinging crank and slotted link makes it possible a combined movement to be obtained, which is determined in a completely mechanical way, essentially comprising a step of approaching of the welding bar towards said products wrapped inside packaging material, an accompanying step during the welding step, a removal step, and a step of quick return to the stand-by position, and representable by means of an upside-down isosceles trapezium with inclined, curved sides.

The important point is that during the (B) step of accompanying during the welding step, the central car 28 horizontally moves in such a way that its motion, causing a change in length of both portions of conveyor belts 19 and 20 in correspondence of the rollers 33 which constitute the so-said roller apron, makes it possible the own movement of the belts 19, 20 to be equated, so that the transversal welding unit 18 remains closed for the necessary time for a correct welding of the wrapping film to be obtained. This is the so-said "slow step" of the welding cycle. The movement of the conveyor belts 19 and 20 in order that the upper portions thereof facing towards the product may vary relatively to each other, and consequently the underlying roller aprons which support them may vary as well, is possible, because, as said, the upper rolls 26 translate together with the car 28, by being integral with it, whilst the lower rollers 27 are made integral with the tightening device 29 and with the chain portions 30, and exactly move in the opposite direction to the direction of displacement of the upper roll 26 positioned on the same side, and nearly at the end of the same chain portion 30.

In fact, one could consider that the two chain portions 30, the tightening device 29 and the lower body of the central car 28 constitute a closed loop which can move around both idle, coaxial sprocket wheels 31, free of rotating relatively to the stationary rolls 25, revolutionary and integral with the framework 11. In this way, inasmuch as the upper, movable welding bar 42, positioned in a nearly bridge-fashion on the upwards extending shoulder portions 39, is driven by a cam-driven movement, and with this movement the movement is combined of the car 28 which supports the welding unit, driven by a swinging crank and slotted link, a combined movement of sinking of the welding bar, and of accompanying of the product with the car during the welding step, derives, which, by realizing the transversal welding precisely in the nearby of the product, makes it possible a saving in the plastic material used for the packaging to be obtained, with an as small amount thereof as possible being consumed. Precisely the arrangement of the welding bar in a bridge-position, the possibility of actuating the cycle of welding at the trailing edge of the product, and the detection of the height of the product being packaged make it possible the above-said optimization in packaging film consumption to be achieved, independently from the height of the product, or of the products to be packaged, with any stop times being got rid of.

Advantageously, the installation according to the invention of pressing devices 82, 83 arranged on the car 28, whose belts 89 have the same linear advancing speed as of the conveyor belts 19, 20, makes it possible both the overlapped products 12 to be perfectly stacked during the welding step, and the individual products with a minimum amount of pages to be packaged. In this latter case, in fact, the upstream pressing device 82 keeps the product spread, and simultaneously pushes it against the packaging film, keeping it in a perfectly flat position, whilst the downstream pressing device receives the leading edge portion of the individual product by now wrapped in the film, and drives it forwards, also it keeping said wrapped product(s) in a perfectly flat position.

A packaging machine according to the invention, thanks to the particular mechanical drive means of cam-crank and slotted link type, and to the presence of at least one pressing device, makes it possible overlapped products of any lengths and heights to be packaged in a perfectly stacked position. In the event the pressing devices are two, the one upstream and the other downstream the transversal welding unit, a perfect and well-spread packaging of one single product with a minimum amount of pages, such as a newspaper, or the like, is made possible.

It should be furthemore stressed that an advancement speed of the conveyor belts is used, which is lower than the advancement speed of the machines known from the prior art, which, in any cases, does not misarrange the overlapped, stacked products, but which makes it possible the production rate to be increased, thanks to the particular type of combined welding unit-car movement, and to the presence of the pressing devices according to the invention.

We claim:

1. Packaging machine for the continuous packaging of individual products, or of groups of overlapped products having a variable height, such as signatures, newpapers, magazines, books and the like, of a type comprising a framework fitted with conveyor means for conveying the products to be packaged, a transversal welding unit for the transversal welding of a plastic material having the form of a continuous sheet suitable for wrapping said products to be packaged, wherein said continuous-sheet material is fed by a couple of bobbins positioned on relevant unwinding units and free ends of said bobbins are transversely welded so as to form a single continuous sheet, with said conveyor means being a first conveyor belt and a second conveyor belt respectively positioned upstream and downstream said welding unit, which is transversal relatively to the direction of unwinding of said packaging material and which is composed by an upper, vertically movable, welding bar, and by a lower welding bar, stationary, and positioned at the same level as of said first and second conveyor belts, with furthermore at least one pressing device being provided, which is vertically movable above said products in the nearby of said welding unit, and relevant motor means and actuator means being provided, characterized in that said welding unit is positioned on a horizontally translatable car, with said car bearing, on opposite sides relatively to said welding unit, a return roller of said first conveyor belt and a return roller of said second conveyor belt, wherein said first conveyor belt and said second conveyor belt run along a closed-loop path and are provided with a belt tightening device suitable for enabling them to correctly operate, a centralized motor means being provided, which, through a first transmission, determines the continuous revolution of said conveyor belts, and, with the interposition of a brake-clutch unit, selectively actuated by sensor means monitoring the position of said products on said conveyor belts, drives an intermediate shaft to revolve in order to actuate a cam for the vertical movement of said upper welding bar and for actuating a crank and slotted link for driving the horizontal reciprocating of said car, with at least one return roller of said conveyor belts causing a belt of said at least one pressing device to move in synchronism with it, and in an opposite direction of revolution, which said at least one pressing device being also positioned on said car, and being vertically shiftable, by being actuated by at least one of said sensor means.

2. Packaging machine according to claim 1, characterized in that said first conveyor belt and said second conveyor belt have a mutually specular shape and run along an essentially trapezoidal closed-loop path, wherein mutually opposite sides of said two paths show each an essentially "C"-shaped recess individuated by a roll fastened to said framework, and by an upper roll and a lower roll which are positioned in correspondence of ends of said sides, with said upper return roll being constrained to said car, and said lower roll of each recess also being a return roll positioned in correspondence of ends of said tightening device, with said ends of said tightening device being fastened to chain portions, which run around sprocket wheels coaxial with said stationary rolls, and at their other end are fastened to said car, nearly in correspondence of said upper return rolls.

3. Packaging machine according to claim 1, characterized in that said cam for the vertical movement of said upper welding bar comprises a disk, positioned integral on said intermediate shaft, provided with an eccentric groove inside which an idle roll is inserted, which extends from a swinging lever, hinged relatively to said framework at one of its ends, and articulatedly linked at its other end to an articulated lever for said vertical movement of said upper welding bar.

4. Packaging machine according to claim 1, characterized in that said swinging crank and slotted link comprises a crank, installed at an end of said intermediate shaft, and provided, inside a groove of its own, with a pin radially positionable in an adjustable way relatively to said intermediate shaft, with said pin rotatably supporting a slider or pad element which enters inside a groove provided in a crank and slotted link lever which is articulated at one of its ends in a swinging way relatively to said framework, and which drives, by means of a tie-rod, said car to horizontally reciprocate.

5. Packaging machine according to claim 1, characterized in that there are provided a pressing device upstream said welding unit, and a pressing device downstream said welding device, with both said pressing devices being operatively linked to a set of sensor means, positioned on said framework at the inlet end of said first conveyor belt, suitable for detecting the height of said products, consequently presetting a time for them to start moving downwards.

6. Packaging machine according to claim 1, characterized in that said first conveyor belt comprises two mutually side-by-side, mutually spaced-apart belts, in order to provide, along their adjacent sides, a positioning area for one of said sensor means, which is destined to detect the trailing edge of the product to be packaged, and is operatively connected with said brake-clutch unit coupled with said centralized drive means, and with at least one pressing device.

7. Packaging machine according to claim 5, characterized in that said pressing device downstream said welding unit is equipped with a further sensor means which causes both its vertical downwards movement to stop, and said upstream pressing device to start returning upwards.

8. Packaging machine according to claim 1, characterized in that said movement in synchronism with, and in the opposite revolution direction as of, a belt of said at least one pressing device is realized by a chain transmission which draws the movement from a sprocket wheel coaxial with said at least one return roller, and drives Cardan joints to revolve, which are provided with rod portions of telescopic type operatively linked, at their opposite free ends, with at least a drive roll for said belt of said at least one pressing device.

9. Packaging machine according to claim 1, characterized in that said at least one pressing device is positioned on a support element which can be vertically shifted by means of a cylinder integral with vertical body sides of said car on guide studs.

10. Packaging machine accoding to claim 5, characterized in that said first conveyor belt comprises two mutually side-by-side, mutually spaced-apart conveyor belts, in order to realize, along their adjacent sides, an area of positioning of one one of said sensor means, which is destined to detect both the leading edge of a single product with a minimum amount of pages, so as to command said upstream pressing device to move downwards and, in succession, said downstream pressing device to move downwards according to a preset time, with said pressing devices being operatively linked to said one from said sensor means, and the trailing edge of said single product having a minimum amount of pages, so as to actuate said brake-clutch unit coupled with said centralized motor means.

* * * * *